US006443793B1

(12) United States Patent
Huebl et al.

(10) Patent No.: US 6,443,793 B1
(45) Date of Patent: Sep. 3, 2002

(54) RECOIL MECHANISM AND DEVICE UTILIZING SAME

(75) Inventors: Steven J. Huebl, Jordan; Louis F. Polk, III, Excelsior, both of MN (US)

(73) Assignee: Leisure Incorporated, Chanhassen, MN (US)

( * ) Notice: Subject to any disclaimer, the term of this patent is extended or adjusted under 35 U.S.C. 154(b) by 0 days.

(21) Appl. No.: 09/466,462

(22) Filed: Dec. 17, 1999

Related U.S. Application Data

(60) Provisional application No. 60/122,542, filed on Mar. 2, 1999.

(51) Int. Cl.[7] ..... A63H 27/00; A63H 27/14

(52) U.S. Cl. ..... 446/61; 242/371; 242/376; 242/379

(58) Field of Search ..... 242/370, 371, 242/376, 379; 446/61, 63, 64, 65

(56) References Cited

U.S. PATENT DOCUMENTS 2,638,708 A * 5/1953 Grow
4,014,478 A * 3/1977 Bonacina
4,064,647 A 12/1977 Lemelson
4,087,934 A * 5/1978 Gibson
4,149,510 A 4/1979 Koga et al.
4,324,064 A * 4/1982 Bettencourt et al.
4,826,099 A * 5/1989 Johnson
4,850,233 A 7/1989 Ishigo
4,940,028 A 7/1990 Tuggle
5,129,852 A 7/1992 Crisci et al. ..... 446/60
5,364,298 A 11/1994 Crisci et al. ..... 446/59
5,395,275 A 3/1995 Johnson et al. ..... 446/60
5,562,522 A 10/1996 Richno ..... 446/444
5,733,164 A 3/1998 Albrecht ..... 446/63

* cited by examiner

*Primary Examiner*—John A. Ricci
(74) *Attorney, Agent, or Firm*—Boyle Fredrickson Newholm Stein & Gratz S.C.

(57) ABSTRACT

A recoil module is provided for use in toy airplanes or other suitable devices. The recoil module includes an outer shell including an outer surface and an interior cavity within the shell. A recoil spool is retained within the cavity of the shell and is supported on an elastic band that spans the interior cavity of the shell. The elastic band is held fixed at its opposed ends by the shell. A pull cord is affixed to a portion of the spool and has an end extending through the shell to the outer surface. The pull cord has a free end that can be grasped to extend the pull cord from the shell and store potential energy in the elastic band. When released, the pull cord retracts back to the interior cavity of the shell. The module shell and the recoil spool can each be constructed for easy snap together assembly. The recoil module can be installed on a toy requiring or benefitting from its use. A recoil device is also disclosed that can be integrated into a toy or other object such as a toy glider airplane.

27 Claims, 5 Drawing Sheets

RECOIL MECHANISM AND DEVICE UTILIZING SAME

This application claims benefit of Provisional Application Serial No. 60/122,542, filed Mar. 2, 1999.

BACKGROUND OF THE INVENTION

1. Field of the Invention

The present invention relates generally to recoil devices, and more particularly to a recoil mechanism that has a modular construction and that is useful for a toy or other such device.

2. Description of the Related Art

Recoil mechanisms are known and used in a number of diverse environments and applications. For example, somewhat complex recoils are commonly employed for pull starting small engines, such as two stroke engines in lawn mowers, chain saws and other small gas powered equipment.

Much simpler recoils or wind-up mechanisms are utilized for small toys such as toy airplanes for winding up and pre-loading a propeller of the airplane. Such arrangements typically include an elastic band attached at one end to the propeller and to a fixed portion of the airplane or to a winding mechanism at its opposite end. One end of the elastic band is held in a fixed position and the opposite end is then wound or twisted, imparting a pre-load in the band and to the propeller. Release of the pre-load then rotates the propeller to propel the airplane. U.S. Pat. Nos. 5,129,852 and 5,364,298 discloses automatic propeller winders for rubber band driven airplanes. U.S. Pat. No. 5,395,275 discloses a manual propeller winding mechanism including a recoil string using a coil spring and clutch assembly.

Other types of devices and toys also use recoils to perform one or more functions of the device. Many toys and devices use a pull cord that, when pulled from the body of the device, stores energy. When the pull cord is released, it returns into the body of the device and the stored energy is used to perform a function. Some of these toys include talking dolls and talking games.

The above-described devices each have a recoil assembly or mechanism that is fairly complex in design and manufacture. Each of these mechanisms also requires a number of parts to assemble the complete unit. The manufacturing and assembly costs are prohibitive for using a recoil assembly in fairly simple, inexpensive products.

U.S. Pat. No. 5,562,522 to Richno discloses a self-propelled toy vehicle with a rubber band drive. The rubber band is coupled at one end to the rear wheels of the vehicle through various gears and is held fixed at its opposite end. Energy is stored in the rubber band by rolling the vehicle rearward. The vehicle is propelled forward by simply releasing the vehicle. This toy illustrates a typical application of a simple rubber band drive or recoil concept without the use of a recoil assembly or mechanism.

Some toy airplanes are gliders and require no mechanical propulsion once they are launched. Gliders, however, require some external force to launch and propel the glider into the air. Most gliders are simply designed to be thrown into the air by a user. Some gliders are supported on a launcher having an elastic band that is stretched and then released to propel the airplane into the air. Most of these types of launchers do not use a recoil mechanism to wind-up any portion of the airplane or the launcher. The elastic band is typically only elongated and released. U.S. Pat. No. 5,064,647 discloses such a glider airplane and launcher.

One example of a glider having a launcher that does not use a rubber band is disclosed in U.S. Pat. No. 5,733,164 to Albrecht. The patent discloses using a stick carrying one or more gliders on its distal end wherein the stick provides greater mechanical advantage and is used to throw the glider upward into the air.

SUMMARY OF THE INVENTION

The present invention is directed to a recoil module for use in any number of devices including toys. The recoil module is simple in construction and inexpensive to manufacture. The module can be completely assembled and installed in any number of devices or toys to produce an intended function. The present invention is also directed to a toy glider airplane utilizing the recoil module as a launching aid. The recoil module of the invention permits producing a significantly increased launching speed over prior known glider launching techniques and devices.

In order to achieve these and other objects, features and advantages of the present invention, in one embodiment a recoil module has a shell with an outer surface, a first end and a second end opposite the first end. A cavity is defined within the shell and has an elastic band extending through the cavity between the first end and the second end of the shell. A recoil spool is suspended on the elastic band within the cavity and has a retractable pull cord connected at one end to the spool. A free end of the pull cord passes through the shell to the outer surface of the shell.

In one embodiment, the shell is formed having a first shell section and a second shell section that are removably connected to one another to define the cavity between the two shell sections.

In one embodiment, the two shell sections are injection molded plastic and designed to snap together. In another embodiment, the two shell sections have a flexible living hinge forming an integral clamshell construction.

In one embodiment, a post is disposed on each end of the shell over which the elastic band attaches. In one embodiment, the posts are parallel to a longitudinal axis of the shell and defined by providing a U-shaped opening at each end of one of the shell sections. In another embodiment, the posts are perpendicular to the longitudinal axis of the shell. In one embodiment, the elastic band is captured between the two shell sections at each of the first and second ends of the shell securely holding the elastic band therebetween. In another embodiment, the elastic band is received around each of the posts.

In one embodiment, one of the shell sections includes an opening defined therein through which the free end of the pull cord passes to the outer surface of the shell. In one embodiment, a ring having a smooth surface is received in the opening.

In one embodiment, the free end of the pull cord has a pull ring or other grasping device attached thereto.

In one embodiment, the recoil spool includes two spool sections that sandwich the elastic band therebetween when assembled. In one embodiment, the recoil spool defines contoured openings at opposite ends of the spool through which the elastic band passes. The contoured openings conform to the shape of the elastic band to prevent the elastic band from twisting about its longitudinal axis relative to the recoil spool.

In one embodiment, the elastic band is an endless rubberband.

In another embodiment of the present invention, a glider airplane has an airplane body with at least one airfoil. A recoil device is carried by the airplane body and has a retractable pull cord with a free end extending from the recoil device. The pull cord fully extends from the airplane body when the pull cord is held and swung about the free end and automatically retracts into the airplane body when the free end is released.

In one embodiment, the recoil device of the glider airplane has an elastic band extending through a cavity in the airplane body. A recoil spool is suspended on the elastic band within the cavity. A fixed end of the pull cord opposite the free end is connected to the recoil spool.

In one embodiment of the glider airplane, the recoil device is a recoil module that has a shell carried by the airplane body wherein the shell has an outer surface, a first end and a second end opposite the first end. A cavity is defined within the shell.

In one embodiment, the recoil module of the glider airplane is removable from the airplane body.

In another embodiment of the present invention, a method of launching a glider airplane includes first providing a glider airplane having a retractable pull cord carried thereon. A free end of the pull cord is grasped by an individual. The airplane is then swung about the free end so that the pull cord extends completely from the airplane. The free end of the pull cord is then released by the individual to launch the airplane into the air.

These and other objects, features and advantages of the invention will become apparent to those skilled in the art from the following detailed description and the accompanying drawings. It should be understood, however, that the detailed description of the specific examples, while indicated preferred embodiments of the present invention, are given to illustrate and not to limit the present invention. Many changes and modifications can be made within the scope of the present invention. The invention includes all such modifications.

BRIEF DESCRIPTION OF THE DRAWINGS

One or more exemplary embodiments of the invention are illustrated in the accompanying drawings in which like reference numerals represent like parts, and in which.

DETAILED DESCRIPTION OF ONE OR MORE EMBODIMENTS

Figure 1:
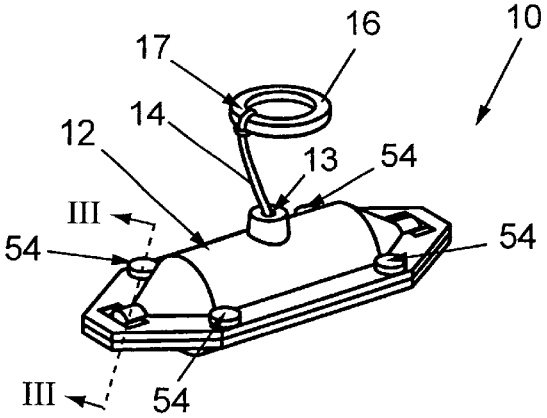
FIG. 1 illustrates a perspective view of a recoil module constructed in accordance with one embodiment of the present invention.

The present invention is directed to a modular recoil assembly that can be utilized in any number of applications. A recoil module 10 constructed in accordance with one embodiment of the present invention is illustrated in FIG. 1 and has a module shell 12 and an opening 13 in the shell through which a pull cord 14 extends. A pull ring or loop 16 is attached to the free end 17 of the pull cord 14 and can be grasped in order to withdraw the pull cord from the module shell 12.

Figure 2:
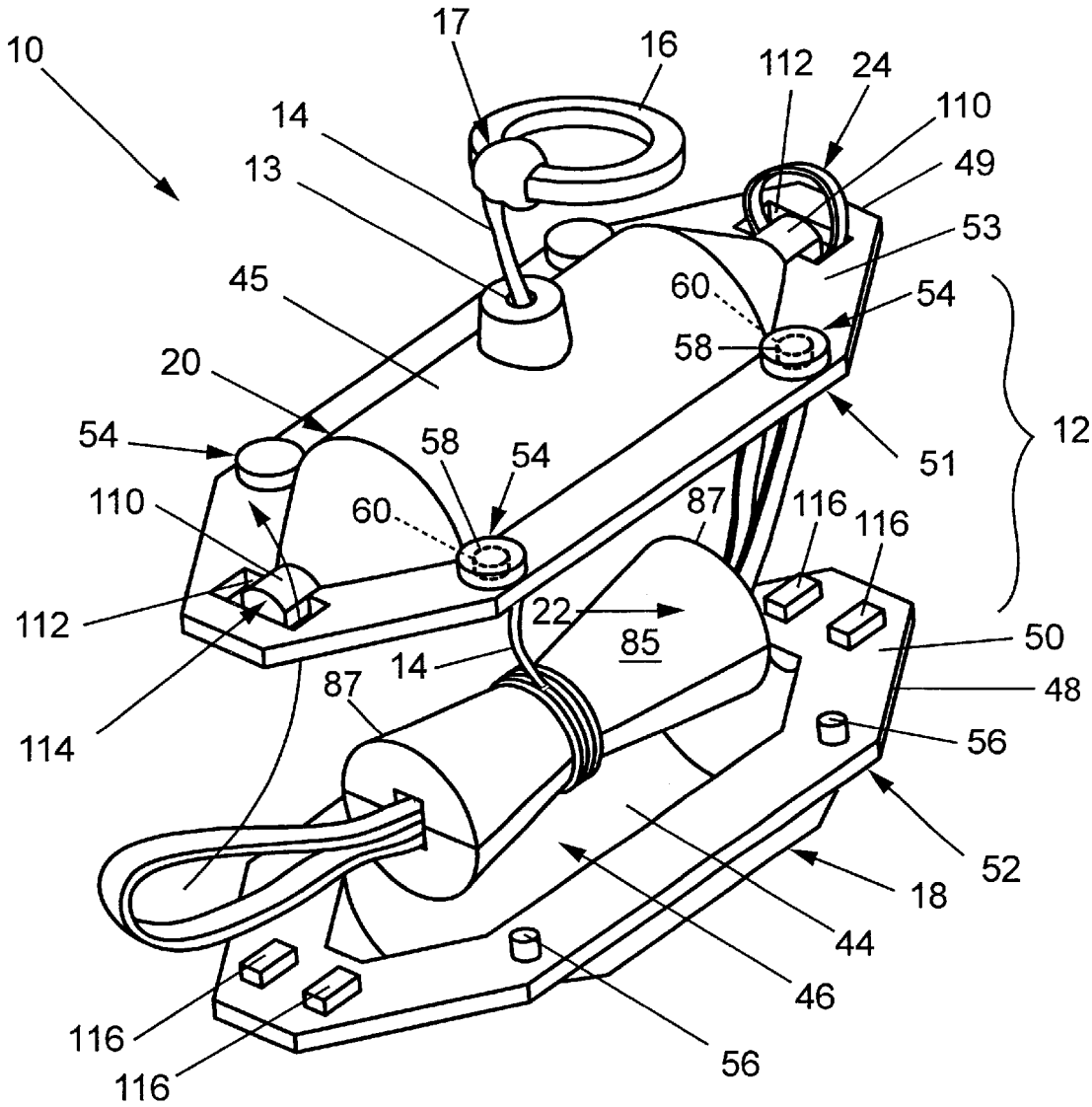
FIG. 2 illustrates an exploded perspective view of the recoil module illustrated in FIG. 1.
Figure 3:
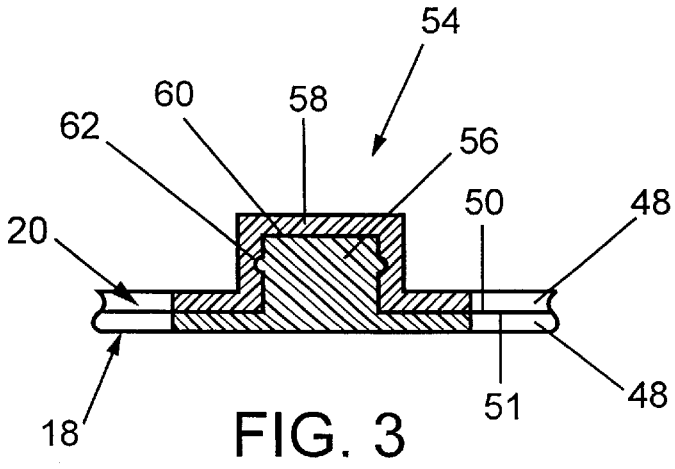
FIG. 3 illustrates a cross-section of a snap together device taken along line III—III of FIG. 1.

FIG. 1 shows the recoil module 10 in an assembled condition with the pull cord 14 and pull ring 16 in a retracted position. Referring to FIG. 2, the recoil module 10 is shown in exploded view to illustrate the internal working components of the module. The module shell 12 includes two complimentary shell sections, a first section 18 and a second section 20. Sandwiched between the two shell sections 18 and 20 is a recoil spool 22 suspended on an elastic band 24. The elastic band 24 is held at its opposite ends 26 and 28 by a portion of the module shell 12. In one embodiment, the elastic band 24 is an ordinary, endless rubberband.

The pull cord 14 has a fixed end 30 that in one embodiment includes a knot 32. The pull cord 14 passes through the opening 13 and through openings in the spool 22 and prevented from returning through the spool by the knot 32. The pull cord 14 is wound around the spool 22 and placed within the module shell 12 with the elastic band 24 in an initial condition. The elastic band is preferably provided in its initial condition having a slight pre-wind to ensure that the pull cord 14 fully returns as described below.

To operate the recoil module 10, a user simply pulls on the ring 16 to extend the pull cord 14 from the module shell 12. By doing so, the spool 22 rotates as the pull cord 14 unwinds and begins to wind up the elastic band 24. Because the fixed ends 26 and 28 of the elastic band are held securely by the modular shell 12, the elastic band 24 winds up and stores potential energy therein. When the user releases the ring 16, the stored energy of the elastic band 24 rotates the spool 22 in the opposite direction from which it was rotated by pulling on the pull cord 14. The unwinding of the elastic band 24 retracts the pull cord 14 back into the modular shell 12 until the elastic band returns to its initial condition.

The modular shell 12 and spool 22 can take on a number of configurations and constructions without departing from the spirit and scope of the present invention. With that in mind, reference is made to FIGS. 1–5 and to the following discussion particularly describing the various components of the recoil module 10 of the invention.

Figure 4:
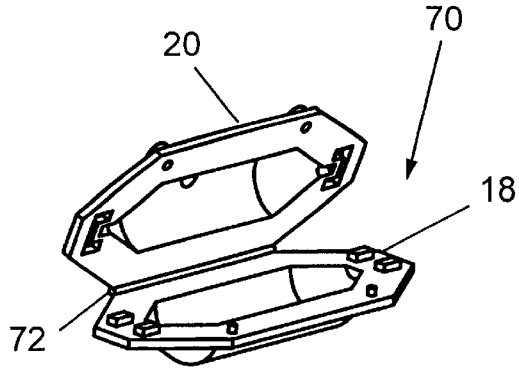
FIG. 4 illustrates an alternative embodiment of a module shell for the recoil module shown in FIG. 1.

The particular construction details of the module shell 12 can vary considerably without departing from the scope of the invention. FIGS. 2 and 4 illustrate two of many possible alternative embodiments of the shell 12. In one embodiment, the shell 12 has two separate snap together shell sections 18 and 20 shown in FIG. 2. The particular construction of the module shell 12 will depend upon the shape and characteristics of the toy or other device, such as a toy airplane, for which the module is intended.

Referring now in more detail to FIG. 2, the modular shell 12 includes the two shell sections 18 and 20 wherein each section has a concave interior or recess 44 and 45, respectively. The concave interiors 44 and 45 face and abut one another when the modular shell 12 is assembled. The two recesses 44 and 45 define the entirety of a cavity 46 between the two sections 18 and 20 when assembled.

Each shell section 18 and 20 also has an outwardly extending perimeter flange 48 and 49, respectively. Each flange 48 and 49 has a mating surface 50 and 51, respectively, which abut against one another when the shell 12 is assembled. Each shell section 18 and 20 also has an outer surface 52 and 53, respectively, that is opposite the corresponding mating surface and recess. The modular shell 12, as generally illustrated in FIG. 1, includes one or more engagement devices 54 which can take on any number of configurations and constructions without departing from the scope of the invention. The engagement devices 54 in one preferred embodiment permit the two shell sections 18 and 20 to snap together in order to remain securely attached and yet permit separation when desired by application of an external force upon the shell. The number and construction of these engagement devices can vary as desired for a particular construction of the recoil modular 10.

As shown in FIG. 2, in one embodiment, an engagement device 54 includes an upstanding button 56 extending from the mating surface 50 of the flange 48 of the first shell section 18. The button 56 is received in a receptor 58 carried on the flange 49 of the second shell section 20. In this embodiment, four engagement devices 54 are utilized. Each receptor 58 defines a recess 60 for receiving a corresponding button 56 therein when the two shell sections 18 and 20 are assembled.

In one embodiment, a detent 62 is included on the button 56 and receptor 58, providing a relatively secure assembly of the two modular sections 18 and 20. The detent can include an annular protrusion extending around and from a portion of the button 56 and a corresponding annular groove extending into the receptor 58 for receiving the protrusion therein. The detent 62 construction can vary without departing from the scope of the invention. Alternatively, as illustrated in phantom view in FIG. 2, the buttons 56 and receptors 58 can simply have planar walls without a detent. When assembling the two modular sections 18 and 20 together where no positive detent is provided on the engagement devices 54, either surface friction or an adhesive can be used to secure the two parts together. Alternatively, the button and receptor can be heat welded or sonically welded to one another if the two components are made from plastic. Conventional fasteners can also be used.

As will be evident to those skilled in the art, the means by which the two modular shell sections 18 and 20 are assembled and held together can vary without departing from the spirit and scope of the invention. Many snap or clasp devices are known in the art that can be utilized as the engagement devices to secure the two components to one another. The goal of the present invention is to provide a module shell that can be disassembled if necessary to fix or replace components. In a preferable embodiment, the two sections positively snap together and yet can be disassembled if desired.

FIG. 4 illustrates an alternative embodiment of the modular shell. In this embodiment, a modular shell 70 has a clam-shell construction wherein the two shell sections 18 and 20 are interconnected along a common edge by an integral web of material 72, known in the art as a living hinge. In this embodiment, the two sections 18 and 20 are molded as a single unit and interconnected along the one edge by the integrally formed living hinge 72. The hinge 72 is flexible permitting the two shell sections to open relative to one another. When the module shell 70 is assembled, it is virtually identical to the embodiment disclosed in FIGS. 1 and 2 having the two separate shell sections 18 and 20.

As will be evident to those skilled in the art, the modular shell 12 as well as the modular shell 70 can vary considerable in shape and construction. In general, the modular shell encapsulates the inner workings of the recoil module 10 therein and protects them from damage. The shape, material, construction, and assembly characteristics of the module shell can vary quite readily and still fall within the scope of the present invention.

The embodiment of FIG. 4 still preferably has at least one or preferably, at least two engagement devices 54 as previously described in order to securely hold the two shell sections 18 and 20 together. Again, the form and construction of the engagement devices can vary without departing from the scope of the invention and yet perform the intended function of securely but releasably holding the two sections together.

Figure 5:
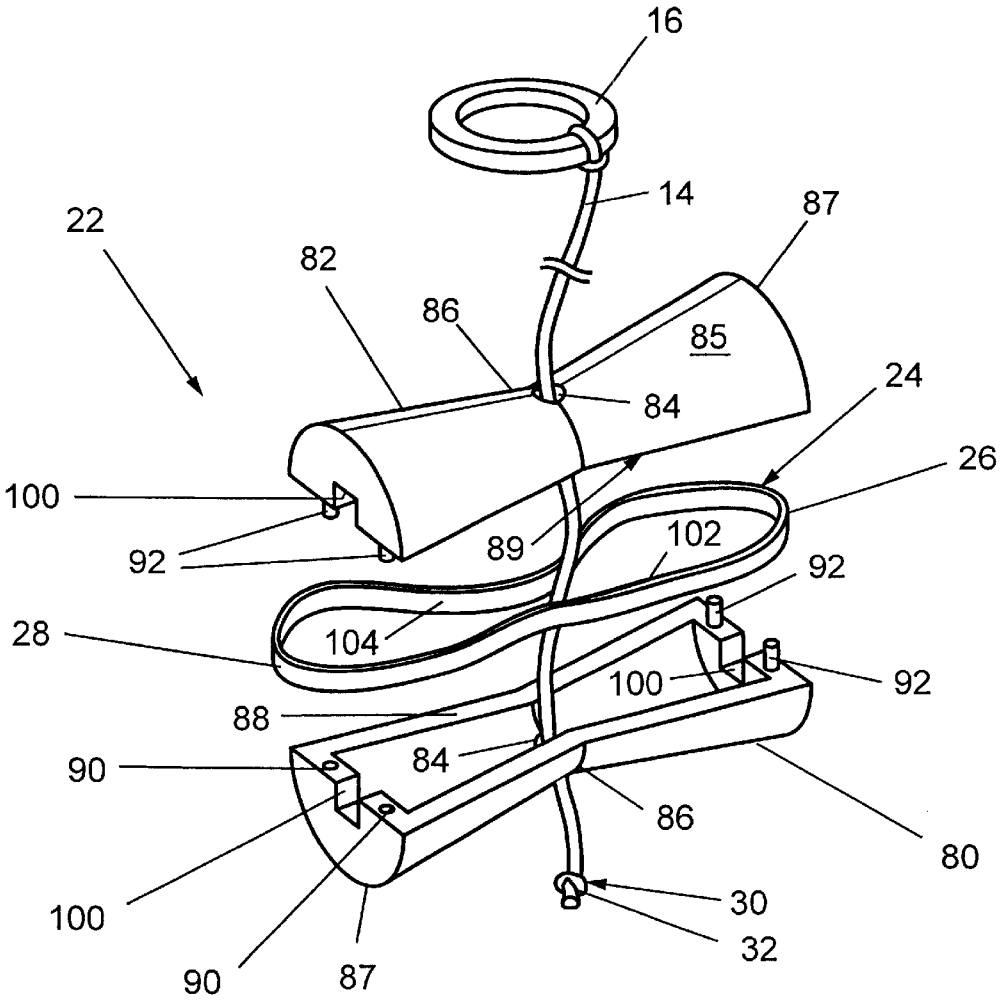
FIG. 5 illustrates an exploded perspective view of a recoil spool and elastic band separate from the recoil module shown in FIG. 1.

As shown in FIG. 5, the recoil spool 22 in one embodiment has two halves or spool sections 80 and 82 that sandwich a portion of the elastic band 24 between them. The pull cord 14 is affixed to the spool 22 so that the fixed end 30 will not completely separate from the spool. In the embodiment illustrated in FIG. 5, each spool section 80 and 82 has a central opening 84, each of which correspond to the other when the spool 22 is assembled. The pull cord 14 is passed through the openings 84 until the knot 32 prevents the pull cord 14 from pulling back through the openings. The pull cord 14 can be attached to the spool 22 in any manner as long as the fixed end 30 does not separate from the spool 22. In another embodiment, only one section of the spool 22 has an opening so that the fixed end 30 of the pull cord 14 is secured within the spool between the two sections 80 and 82 by the knot 32. The fixed end 30 can be otherwise adhered or held to the spool or between the two spool sections when assembled. The present invention is intended to encompass those constructions not particularly described herein.

FIG. 2 best illustrates the assembled spool 22, the elastic band 24 and the pull cord 14. An exterior surface 85 of the spool 22 in one embodiment has an hourglass or dual-tapered contour so that a center 86 of the spool has a smaller diameter than the diameter of its distal ends 87. The center 86 of the spool exterior surface 85 is aligned with the openings 84 and thus with the fixed end 30 of the pull cord 14. This permits the pull cord 14 to be wound around the exterior surface 85 near the smaller diameter center 86 to retain the pull cord on the spool 22. Alternative outer spool surface contours can be utilized that will also assist in forcing the pull cord 14 to wind around the center of the spool and will prevent the pull cord from sliding off one of the distal ends 87. In addition, the exterior surface 85 of the spool 22 can have grooves or other such surface formations to further guide the pull cord 14 around the spool 22.

The recoil spool 22 can assemble somewhat similarly to the modular shell 12 as described above. As best illustrated in FIG. 5, each spool section 80 and 82 defines one half of the spool body. Each half section 80 and 82 includes a mating surface 88 and 89, respectively, that abut one another when the spool 22 is assembled. As illustrated in FIG. 5, in one embodiment, each mating surface 88 and 89 includes a pair of receptor openings 90 at one end and a pair of protruding posts 92 at the opposite end of each spool section.

As shown in FIG. 5, each section of the spool is identically constructed. When one section is positioned so that the posts 92 align with the receptors 90 of the opposite spool section, each post 92 is received in a receptor 90 providing for assembly of the spool 22.

This construction permits fabricating only one tool to form the spool sections, saving manufacturing cost and reducing complexity. Again, an adhesive, heat welding, sonic welding or the like may be utilized to securely attach the two spool sections 80 and 82 together. Alternatively, as described above for the modular shell, the receptor openings 90 and post 92 can include a detent arrangement to provide a positive snap together assembly for the spool 22. The spool sections can also be constructed with the posts on one section and the receptors on the other, similar to the shell 12 described above. The shell 12 can alternatively be formed with the two sections as mirror images as well, similar to the spool 22.

The elastic band 24 is also shown in FIG. 5 as being received between the two spool sections 80 and 82. A cutout 100 is provided at each end of each spool section 80 and 82 to define axially aligned openings to receive therethrough a portion of the elastic band 24. It is preferable that the elastic band 24 be symmetrically aligned along the longitudinal axis of the spool 22 to prevent excessive wobbling during winding and unwinding. It is, however, possible that the cutout be provided in only one spool at each end. It is also preferable that the cutouts 100 define openings in the spool 22 when assembled that are large enough to permit the elastic band 24 to pass through the spool 22 without pinching the band, and yet be contoured and have a particular size so that the elastic band is prevented from rotating relative to the spool 22.

Each spool section 80 and 82 is provided with a cavity therein to reduce the weight of the spool 22 as well as to save on material when the components are manufactured. However, the contour of the cutouts 100 can extend throughout the entire length of each spool section 80 and 82 wherein the rest of each spool section would be solid material. Other alternative constructions are also possible and yet remain within the scope and spirit of the present invention.

When assembled, the ends 26 and 28 of the elastic band 24 are held by the modular shell 12. The band 24 is in the initial condition when the cord 14 is fully wound around the spool 22. When an individual pulls the cord 14 outward from the shell 12, the recoil spool 22 rapidly rotates and twists the elastic band 24 to store potential energy in the band. Upon release of the pull cord 14, the elastic band 24 unwinds back to the initial condition, rotates the recoil spool 22 in an opposite direction, and re-winds the pull cord around the spool, retracting the pull cord back into the shell 12. The previously described slight pre-wind in the band in the initial condition assures that the pull cord is completely retracted.

In one embodiment, the elastic band 24 is an endless band that is pulled taught forming two ends 26 and 28 and two elongate sides 102 and 104 that are generally parallel to one another. The two ends 26 and 28 are held securely by the modular shell 12 when the recoil module 10 is assembled so that the elastic band does not rotate about its two ends. This is so that the elastic band stores energy when the cord 14 is pulled and does not dissipate until the pull cord is released.

FIG. 2 best illustrates one embodiment of a shell construction for securely holding the ends 26 and 28 of the elastic band 24. In this embodiment, each module shell section 18 and 20 defines a portion of a mechanism for holding the elastic band. A post 110 extends axially relative to the shell and is formed by a U-shaped cutout or opening 112 in each end of the flange 49 of the second shell section 20. The openings 112 are U-shaped when viewed in plan view so that the posts 110 extend only part way across the opening to define a gap 114 between the end of the post 110 and the material of the flange 49. Each end 26 and 28 of the elastic band 24 passes from beneath the shell section 20 through the gap 114 and over the post 110 and is held thereon. The post preferably has a smooth, rounded contour to prevent damage to the band.

In the embodiment illustrated in FIG. 2, a pair of protrusions 116 extend upward from the mating surface 50 of the flange 48 of the first shell section 18 toward the mating surface 51 of the second shell section 20. The protrusions 116 are received in portions of the opening 112 on opposite sides of the post 110 to register and trap the elastic band material between the protrusions and the post to securely hold the elastic band in place, but without pinching the band. Tension in the elastic band when twisted or wound to store potential energy forces the ends 26 and 28 of the elastic band over the posts 110 toward the center of the modular shell and further prevents the ends from disconnecting from the posts.

The construction illustrated in FIG. 2 for the secure attachment of the elastic band to the modular shell 10 is merely one of many possible embodiments. The ends 26 and 28 of the elastic band 24 can alternatively be sandwiched between the two shell sections 18 and 20 or can be secured over one or more transverse or vertically oriented posts or protrusions. The posts must prevent the ends of the elastic band from being pulled back over the posts when the shell is assembled. The ends 26 and 28 of the elastic band must also be held and prevented from twisting or from pulling toward one another relieving tension in the band when the recoil module 10 is assembled and used.

The construction of the shells 12 and 70, as noted above, can be formed similarly to the spool 22 wherein each section is identical to the other. Here, one post 110 can be formed on one end of the shell on one section and the other post 110 can be formed on the other end of the shell on the other shell section.

Figure 6:
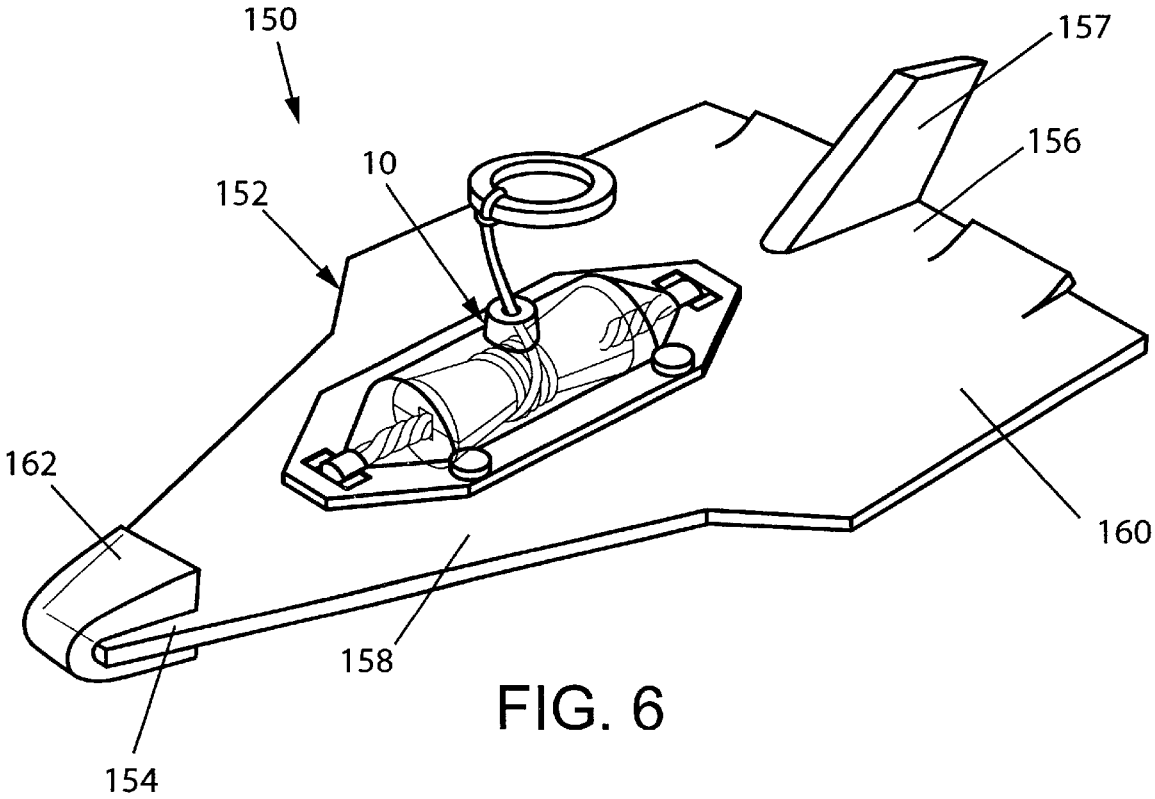
FIG. 6 illustrates a perspective view of one embodiment of a toy airplane of the present invention including a recoil module.

FIG. 6 illustrates one embodiment of a toy glider airplane 150 constructed in accordance with the invention. The glider airplane 150 includes an airplane body 152 with a nose 154, a tail fin 156, a vertical fin 157, a main fuselage 158 and an air foil wing 160. The glider 150 also includes a recoil device such as a module 10 constructed in accordance with the invention. The recoil module 10 is illustrated in partial phantom view in FIG. 6 in order to show the installation and assembly. The recoil module 10 can simply be snapped onto the body 152 of the glider 150 using engagement devices similar to that described for assembling the recoil module shell 12. In such a construction, the entire shell can snap onto the fuselage 158. In an alternative embodiment, the fuselage body 158 can form part of the cavity and replace the first section 18. The second section 20 can snap directly onto the fuselage 158 with the spool and the elastic band sandwiched and held within the cavity defined between the fuselage 158 and the second section 20. In another alternative embodiment, the module 10 can be removably fastened into an opening formed in the fuselage body 158 of the glider 150.

A nose weight 162 is illustrated in FIG. 6 and held on the nose 154 of the glider 150. It is known in the art of glider airplanes that a nose weight assists in balancing the plane providing for smoother and longer flights.

Figure 7:
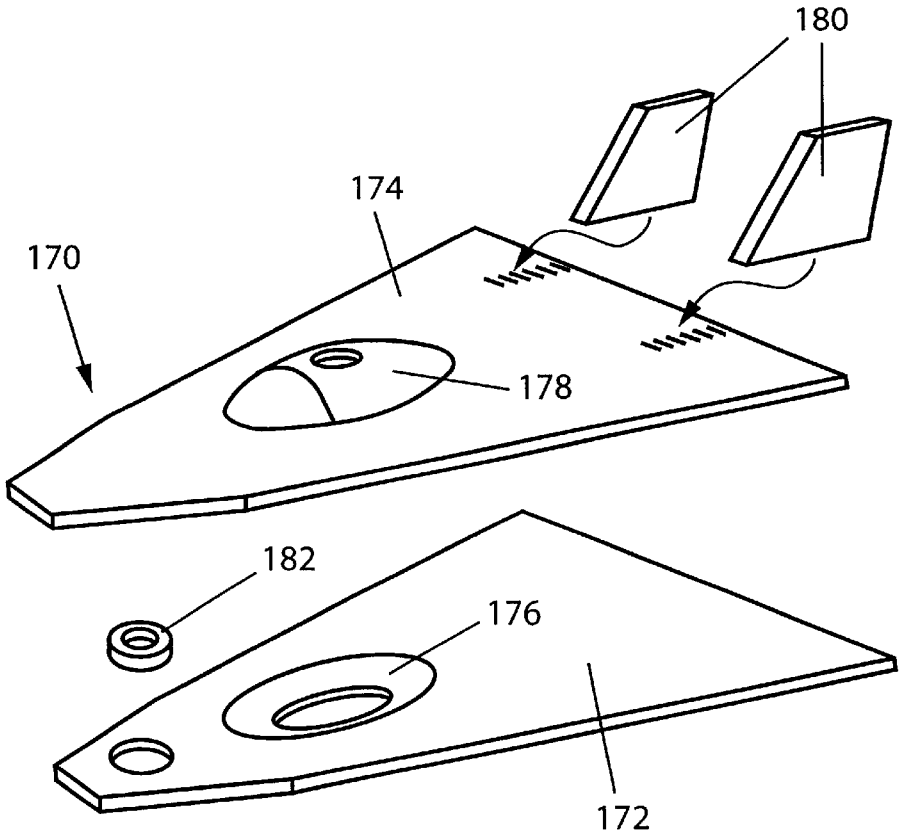
FIG. 7 illustrates an exploded perspective view of another embodiment of a toy airplane of the present invention including the recoil device.

FIG. 7 illustrates another of many possible embodiments of a toy glider airplane 170 utilizing a recoil device of the invention. The glider 170 has two body parts or layers 172 and 174 wherein each part defines a recess 176 and 178, respectively, forming a cavity between them. A recoil module 10 including the shell 12 can be received and held in the cavity between the recesses 176 and 178 when the two body parts are attached or snapped together. The shape of the entire body of the toy airplane is designed as an airfoil in this embodiment, although other embodiments may easily be substituted. In the present embodiment, the body includes a pair of tail fins 180 to provide lateral directional control and stability to the aerodynamics of the toy airplane 170. A weight 182 is also included at the nose of the airfoil and sandwiched between the parts 172 and 174 in order to provide balance and stability.

Figure 8:
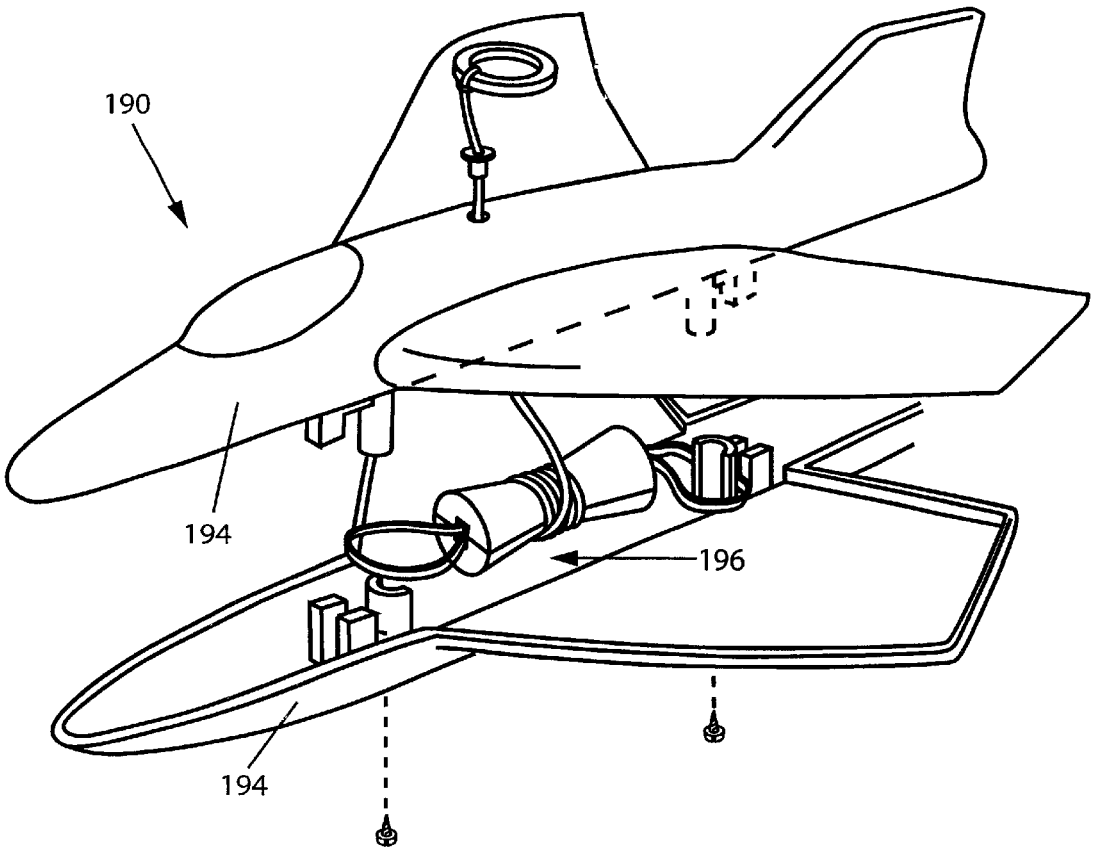
FIG. 8 illustrates an exploded perspective view of another embodiment of a toy airplane of the present invention including a recoil device.

In an alternative embodiment as illustrated in FIG. 8, the interior of a similar glider 190 can be adapted to replace the module shell sections 18 and 20 entirely. In such an embodiment, a recoil device includes only the spool 22, elastic band 24 and pull cord 14, which are sandwiched directly between two layers or sections 192 and 194 of the airplane body in a cavity 196 defined between the sections. To simplify explanation of this embodiment, the flanges 48 and 49 of the module shell sections 18 and 20 illustrated in FIG. 2 are extended to form the remaining airfoil and body of the two sections 192 and 194 of the glider body.

The recoil module 10 or a recoil device without the shell 12 can also be connected to a propeller of a toy airplane in order to easily wind up and rotate the propeller. Additionally, it is contemplated that the recoil module 10 or a recoil device of the invention can be utilized with other types of toys and devices that require or that will benefit from use of the recoil feature. One such toy is a toy vehicle wherein the recoil assembly is used to wind up the drive wheel or wheels of the toy.

Figure 9:
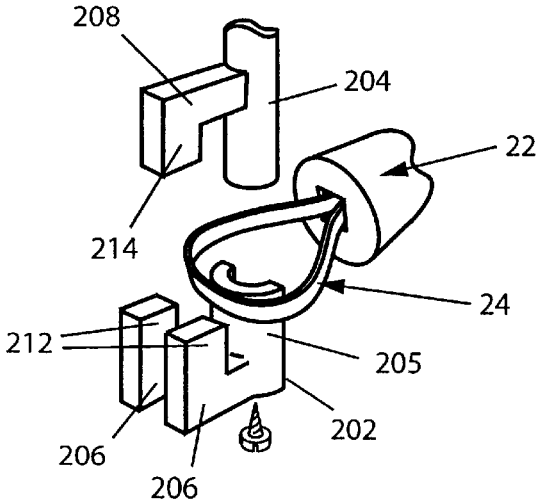
FIG. 9 illustrates an enlarged view of a portion of the toy airplane of FIG. 8 including part of the recoil device.
Figure 10:
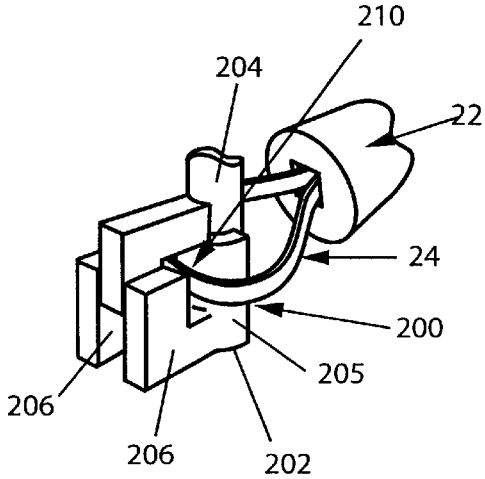
FIG. 10 illustrates the portion of the toy airplane and the part of the recoil device of FIG. 9 when assembled.

FIGS. 9 and 10 illustrate another embodiment for registering and retaining the ends 26 and 28 of the elastic band 24. In this embodiment, a pair of spaced apart and vertically oriented posts 200 are provided, although only one of the posts is illustrated in FIGS. 9 and 10. Each post includes a lower post section 202 carried on the lower airplane body section such as section 194 illustrated in FIG. 9. Each post 200 also includes a complimentary upper post section 204 depending from an upper section of a toy such as the airplane body section 194 illustrated in FIG. 9. The complimentary post sections 202 and 204 when assembled define a continuous post 200 extending vertically across the entire height of a cavity such as the cavity 196 as illustrated in FIG. 9 or other such toy. The ends 26 and 28 of the elastic band are received over the posts 200 prior to assembly of the two post sections. When assembled, the elastic band ends are held by the post and prevented from twisting or moving toward one another.

Figure 11:
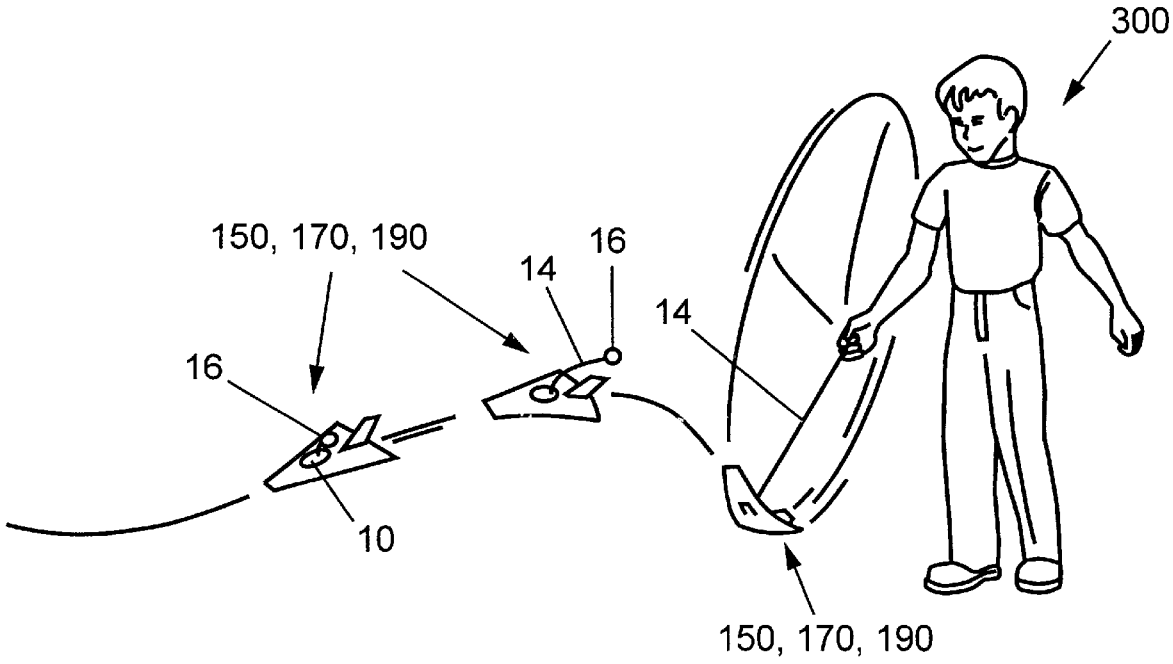
FIG. 11 illustrates a schematic view of an individual user launching a toy airplane utilizing the recoil module or recoil device of the present invention.

In this particular embodiment, the lower post sections 202 include at least a partial exterior surface 205 that is curved or semi-circular and smooth so that the elastic band rides on a smooth surface that does not cut into the band. The lower post sections can be tubular or semi-tubular as illustrated in FIGS. 10 and 11 and yet receive and guide the upper post sections 204 to properly register the two post sections together. As illustrated in FIGS. 9 and 10, the lower post sections 202 include a pair of laterally spaced apart L-shaped tabs 206 protruding from the surface 205 wherein the tabs 206 on one of the lower post sections 202 protrude in opposite directions relative to the tabs 206 on the other of the lower sections 202. Each of the upper post sections 204 includes one L-shaped tab 208 also protruding in the same direction relative to the corresponding tabs 206 on the respective lower post sections 202. Each of the lower tabs 206 includes an upstanding element 212 and each of the upper tabs 208 includes a downturned element 214. Each tab 208 is received between the pair of corresponding tabs 206. The elements 212 and 214 of each post 202 overlap one another and, with the tabs 206 and 208, define a slot 210. The ends 26 and 28 are respectively received through one of the slots 210 and are completely captured.

FIG. 11 illustrates an individual 300 utilizing a toy airplane such as a glider 150, 170, or 190 having a recoil device or a module 10 of the invention and as described herein. The person simply holds the pull ring 16 or other gripping device of the pull cord 14 and swings the toy airplane around one or more times until the pull cord is completely extended from the recoil shell or the airplane body. The person then releases the toy airplane so that it can fly in the direction desired. While the airplane is released and begins to glide, the pull cord 14 returns to within the shell or airplane body as described above.

It is well within the purview of the present invention that the particular construction and details of the recoil module may vary according to the needs of a particular design. Additionally, many types of devices can utilize such a recoil module or device without departing from the scope of the invention. The toy airplanes described above are illustrative examples provided to describe one environment in which the recoil module of the invention may be utilized. The materials used to fabricate the components of the described toy airplane and recoil module may also vary considerably. The recoil shell and spool in one embodiment are injection molded plastic. Other materials however, can be utilized as well. The recoil shells described above can be replaced by parts of a toy, other than the glider 170 described above, and house the spool 22, pull cord 14 and elastic band 24 therein.

The term "recoil module" used herein refers generally to a self-contained recoil mechanism that can be installed in any type of toy or object and yet when not installed in a toy or object can still function as a recoil mechanism. The term "recoil device" utilized herein generally refers to a recoil mechanism that is partly integrated into a toy or object wherein the toy or object defines a portion of or all of the shell 12. Without installation into the toy or object, the spool 22, elastic band 24 and the pull cord 14 would have difficulty functioning as a stand-alone recoil mechanism.

The embodiments illustrated and described herein are not intended to limit the scope of the invention. The invention is intended to be limited only by the scope of the appended claims.

What is claimed is:

1. A recoil module comprising:

a shell having an outer surface, a first end and a second end opposite the first end, and comprised of a first shell section and a second shell section defining a cavity therebetween within the shell;

an elastic band extending through the cavity between the first end and the second end of the shell;

a recoil spool suspended on the elastic band within the cavity; and a retractable pull cord having one end connected to the spool and a free end that extends through to the outer surface of the shell.

2. The recoil module according to claim 1, wherein the first and second shell sections are detachably connected to one another.

3. The recoil module according to claim 1, wherein the first and second shell sections detachably snap together.

4. The recoil module according to claim 1, wherein the first and second shell sections are integrally connected to one another by a flexible hinge along a corresponding edge of each shell section forming a clamshell construction.

5. The recoil module according to claim 1, wherein the first and second shell sections each have a curved semi-spherical section defining a recess therein wherein the recess of each of the first and second shell sections face one another and define a cavity therebetween when the shell is assembled.

6. The recoil module according to clam 1, wherein the first shell section has an opening therein through which the free end of the pull cord passes to the outer surface of the shell.

7. The recoil module according to claim 1, wherein the shell and the recoil spool are formed of a molded plastic material.

8. The recoil module according to claim 1, wherein the shell includes at least one mechanism on each end of the shell, each mechanism securely holding an end of the elastic band.

9. The recoil module according to claim 1, wherein the shell defines an opening through which the pull cord passes.

10. The recoil module according to claim 1, wherein a pull ring is attached to the free end of the pull cord adjacent the outer surface of the shell.

11. The recoil module according to claim 1, wherein the recoil spool has a first spool section and a second spool section connected to one another to form the recoil spool.

12. The recoil module according to claim 11, wherein the elastic band passes through and is sandwiched between the two spool sections and wherein the elastic band is prevented from rotating relative to the recoil spool when sandwiched between the two sections.

13. The recoil module according to claim 1, wherein the elastic band is an endless rubberband.

14. A glider airplane comprising:

an airplane body having at least one airfoil; and a recoil device carried by the airplane body, the recoil device having a retractable pull cord with a free end wherein the pull cord extends from the airplane body when the pull cord is held and swung about the free end and wherein the pull cord retracts into the airplane body when the free end is released.

15. The glider airplane according to claim 14, wherein the recoil device further comprises:

an elastic band extending through a cavity in the airplane body;

a recoil spool suspended on the elastic band within the cavity; and a fixed end of the pull cord opposite the free end, the fixed end being connected to the recoil spool and the pull cord being wound around the recoil spool when retracted into the airplane body.

16. The glider airplane according to claim 14, wherein the recoil device further comprises:

a shell carried by the airplane body, wherein the cavity is defined within the shell.

17. The glider airplane according to claim 14, wherein the recoil device is removable from the airplane body.

18. The glider airplane according to claim 14, wherein the recoil device is a recoil module comprising:

a shell carried by the airplane body, the shell having an outer surface, a first end and a second end opposite the first end;

a cavity defined within the shell;

an elastic band extending through the cavity between the first end and the second end of the shell;

a recoil spool suspended on the elastic band within the cavity; and a retractable pull cord having a fixed end connected to the spool and a free end that extends through the shell to the outer surface of the shell.

19. A method of launching a glider airplane, the method comprising:

providing a glider airplane having a retractable pull cord carried thereon;

grasping a free end of the pull cord;

swinging the airplane about the free end of the pull cord so that the pull cord extends from the airplane; and releasing the free end of the pull cord to launch the airplane.

20. A recoil module comprising:

a shell having a pair of spaced apart ends and a cavity therein;

an elastic band in the cavity that extends between the pair of ends;

a recoil spool in the cavity that is carried by the elastic band, wherein the recoil spool is comprised by a plurality of spool sections; and a retractable pull cord connected to the spool and having a free end that extends outwardly of the shell.

21. The recoil module according to claim 20 wherein the recoil spool has a pair of ends with an opening in each end, the elastic band extends through the recoil spool with the elastic band having one end extending through the opening in one end of the recoil spool and having another end extending through the opening in the other end of the recoil spool, and the elastic band having a pair of ends with one end attached to the shell adjacent one end of the shell and the elastic band having its other end attached to the shell adjacent the other end of the shell.

22. The recoil module according to claim 20 wherein the recoil module is carried by a toy, the shell is comprised of a pair of sections that snap together around the elastic band and the recoil module comprises a propulsion system for the toy.

23. A recoil module carried by a toy comprising:

a shell having a pair of spaced apart ends and a cavity therein;

an elastic band in the cavity that extends between the pair of ends;

a recoil spool in the cavity that is carried by the elastic band, wherein the recoil spool has a pair of openings with the elastic band disposed in the recoil spool with the elastic band extending outwardly through each end in the recoil spool;

a retractable pull cord connected to the spool and having a free end that extends outwardly of the shell; and wherein the elastic band rotates the recoil spool and, when rotating, the recoil spool provides propulsion to the toy.

24. The recoil module according to claim 23 wherein the elastic band has a pair of ends that are each attached to the housing and the housing forms part of the toy.

25. The recoil module according to claim 24 wherein the toy comprises an aircraft.

26. A recoil module of a toy comprising:

a shell comprised of a plurality of shell sections that snap together, the shell having a cavity therein and a pair of spaced apart ends;

a recoil spool comprised of a plurality of spool sections that snap together, the recoil spool having a pair of openings and disposed in the cavity in the shell, an elastic band that is disposed in the recoil spool and that has a first portion that extends through one of the openings in the recoil spool and attaches to the shell and that has a second portion that extends through the other one of the openings in the recoil spool and attaches to the shell;

a pull cord connected to the recoil spool and having a portion that extends outwardly of the shell; and wherein the elastic band rotates the recoil spool to provide propulsion to the toy.

27. The recoil module according to claim 26 wherein the pull cord is pulled out of the housing and released to cause the elastic band to rotate the recoil spool, and wherein the toy is an aircraft.

* * * * *